US006085912A

United States Patent [19]

Hacking, Jr. et al.

[11] Patent Number: 6,085,912

[45] Date of Patent: Jul. 11, 2000

[54] APPARATUS FOR SORTING AND RECOMBINING MINERALS BACKGROUND OF THE INVENTION

[76] Inventors: Earl L. Hacking, Jr., N 2780-730th St., Hager City, Wis. 54014; Thomas A. Swaninger, 15235 Pinewood Trail, Linden, Mich. 48451

[21] Appl. No.: 09/352,729

[22] Filed: Jul. 13, 1999

[51] Int. Cl.[7] ..... B03B 7/00; B03B 9/00

[52] U.S. Cl. ..... 209/17; 209/10; 209/12.1; 209/3.2; 209/256; 366/16; 366/17; 366/152.1; 366/160.1

[58] Field of Search ..... 209/3, 10, 12.1, 209/17, 3.2, 255, 256, 258; 366/16, 17, 37, 30, 152.1, 160.1

[56] References Cited

U.S. PATENT DOCUMENTS

| | | | |
|---|---|---|---|
| 1,939,119 | 12/1933 | Holt et al. | 209/12 |
| 2,179,485 | 11/1939 | Avril . | |
| 2,352,324 | 6/1944 | Hubler | 209/17 |
| 2,623,637 | 12/1952 | Fontein | 209/3 |
| 3,182,969 | 5/1965 | Rupp . | |
| 3,424,308 | 1/1969 | Fenske | 209/10 |
| 3,547,411 | 12/1970 | Sowell . | |
| 3,868,262 | 2/1975 | Ohlson . | |
| 3,900,292 | 8/1975 | Fairchild | 23/273 |
| 4,028,228 | 6/1977 | Ferris et al. | 209/39 |
| 4,032,436 | 6/1977 | Johnson . | |
| 4,144,164 | 3/1979 | Absil et al. | 209/12 |
| 4,152,257 | 5/1979 | Giffard . | |
| 4,159,248 | 6/1979 | Taylor et al. | 210/96.1 |
| 4,175,035 | 11/1979 | Moyer, Jr. | 209/17 |
| 4,222,787 | 9/1980 | Jones . | |
| 4,405,453 | 9/1983 | Wells | 209/172.5 |
| 4,409,096 | 10/1983 | O'Brian . | |
| 4,436,433 | 3/1984 | Barnes . | |
| 4,488,815 | 12/1984 | Black | 366/8 |
| 4,619,550 | 10/1986 | Jeppson . | |
| 4,712,742 | 12/1987 | Ogawa et al. . | |
| 5,022,316 | 6/1991 | Williams . | |
| 5,076,702 | 12/1991 | Smals | 366/2 |
| 5,590,958 | 1/1997 | Dearing, Sr. et al. | 366/20 |
| 5,794,791 | 8/1998 | Kindig | 209/727 |
| 5,824,210 | 10/1998 | Kruyluk | 209/3 |

*Primary Examiner*—Donald P. Walsh
*Assistant Examiner*—David A. Jones
*Attorney, Agent, or Firm*—Nikolai, Mersereau & Dietz, P.A.

[57] ABSTRACT

An apparatus for separating a mixture of mineral particles and recombining the mineral particles in an alterable, controlled fashion to create a plurality of products each having a predetermined, desired particle size distribution.

19 Claims, 5 Drawing Sheets

| OPERATOR INPUTS | | | |
|---|---|---|---|
| VARIABLE | VALUE | | |
| | OP. ENTRY | SYST. VAL. | DESCRP. |
| RAW FEED FLOW RATE TPH | 400.0 | 400.0 | TPH |
| SIZE FOR INGR # 1/DENSITY SET PT. SEPRTR # 1 | 50.0 | 50.0 | =SIZE |
| SIZE FOR INGR # 1/DENSITY SET PT. SEPRTR # 2 | 40.0 | 40.0 | =SIZE |
| RATIO OF INGR # 5 IN PRODUCT # 3 | 65.0 | 65.0 | % |
| RATIO OF INGR # 3 IN PRODUCT # 3 | 35.0 | 35.0 | % |
| RATIO OF INGR # 1 IN PRODUCT # 4 | 60.0 | 60.0 | % |
| RATIO OF INGR # 2 IN PRODUCT # 4 | 30.0 | 30.0 | % |
| RATIO OF INGR # 3 IN PRODUCT # 4 | 10.0 | 10.0 | % |
| DESIRED TPH PRODUCT # 3 (FIRST PRIORITY) | 100.0 | 100.0 | TPH |
| DESIRED TPH PRODUCT # 4 (SECOND PRIORITY) | 200.0 | 200.0 | TPH |

| TYPICAL MEASUREMENTS OR CALCULATED VALUES | | |
|---|---|---|
| DESCRIPTION | TYPE | VALUE |
| FLOW IN TPH | 4-20mA | 400.0 |
| D SEP. 1 OUT TPH | CALCULATED ON VALUE POSITION | 200.0 |
| D SEP. 1 OUT TPH | CALCULATED ON VALUE POSITION | 160.0 |
| LAST CARRYOVR TPH | CALC. | 40.0 |
| PROD. #4 TPH | 4-20mA | 59.5 |

| TYPICAL RAW FLOW COMPOSITION IN % PER LAB TESTS | | |
|---|---|---|
| COMPONENT # 1 | 50.00 | TEST # 1 |
| COMPONENT # 2 | 35.00 | TEST # 1 |
| COMPONENT # 3 | 15.00 | TEST # 1 |
| PRODUCT # 1 % OF FLOW | 35.00 | TEST # 2 |

FIG. 2

APPARATUS FOR SORTING AND RECOMBINING MINERALS BACKGROUND OF THE INVENTION

BACKGROUND OF THE INVENTION

1. Field of the Invention

The present invention relates to an apparatus for sorting mixtures of minerals into constituent parts and then recombining the materials into mixtures containing two or more of the constituent parts in alterable predetermined ratios. More specifically, the apparatus of the present invention uses a plurality of density separators, control valves, sensors, and splitters, all operated under programmed control, to first divide a mixture of minerals into its constituent parts and then use the constituent parts to create one or more end products, each of a predetermined composition.

2. Description of the Prior Art

It is well known in the construction arts that the nature and durability of various construction materials which incorporates sand vary based upon the particle size distribution of the sand used. Thus, various techniques have been employed in the prior art to treat raw sand and other minerals, the constituent parts of which are of an unknown and non-uniform size, to obtain at least one sand product which meets the desired specification. These same techniques have been employed with other particulate materials.

The prior art techniques often incorporate the use of one or more density separators which divide a source material into a relatively coarse underflow fraction and a relatively fine overflow fraction. The density separators typically include equipment, such as a valve, for varying the size of the material as required by varying the flow rate of the under-flow fraction in relation to the pulp density from the density separator.

It is also useful, at times, to blend together two or more products of different particulate specifications in order to achieve a blended product which meets specifications demanded by a customer. One way of achieving such a blend would be to store in bins two or more different output fractions from the density separator and then draw from the bins whatever relative weights of materials are required for blending. This technique suffers from several disadvantages. First is the cost of the weigh scales and the bins. Second is the space required for such equipment. Third is the lack of uniformity of the blend produced with such equipment.

Another significant problem associated with blending operations relates to the efficiency of the process used. Efficiency, of course, is affected if sufficient quantities of each of the materials to be blended is not available. Thus, to maximize the yield of specified products from available raw material, there is a real need for a blending control strategy that is able to pace the flow rates of raw material, the constituent materials separated out from the raw material, and the end product or products. Likewise, it is desirable to establish ratios of different final products from a plant while at the same time maintaining the individual product integrity. This, realistically, can only be efficiently achieved by the automatic operation of the plant.

SUMMARY OF THE INVENTION

The present invention represents an attempt to ameliorate all of the above-mentioned disadvantages, and also to address the needs outlined above. Thus, in accordance with the present invention, the apparatus comprises one or more density separators, a control valve associated with each density separator for varying as required the flow of the underflow fraction from the density separator to maintain the proper size of material in the underflow, sensors for measuring various parameters including, for example, the pulp density of material in each density separator, and splitters all under automatic programmed control. This equipment can be used not only for separating the material into fractions having known characteristics, but also to subsequently combine such fractions in a desired ratio to achieve a plurality of desired products each meeting a desired specification.

Accordingly, the various density separators are used to separate a raw material into various constituent parts. For example, the density separators are able to separate sand by size. Once the density separators have served the function of separating the material into various constituent parts, the splitters are used to control the flow and mixing of the various constituent parts to achieve final products which are in accord with established product specifications. The operation of the splitters and valves of the density separators are all under programmed control by an electronic controller such that the composition of the constituent parts created by the density separators can be easily altered. The system can also readily alter the ratio of the constituent parts in the final products. As indicated above, an important application of the invention is the blending of sands. In this application, some or all of the supplies of sand for blending may be derived from the density separator. The sand is sorted by size by using the density separator and then is reblended into final products using the splitters of the system.

BRIEF DESCRIPTION OF THE DRAWINGS

For a better understanding of the invention, and to show more clearly how the same may be carried into effect, reference is made to the accompanying drawings which are a preferred embodiment of the invention. Various other embodiments can also be assembled using the constituent parts of the invention as shown in the drawings without deviating from the invention.

FIG. 2 is a chart showing operating parameters of a first embodiment of the control system for controlling the separation and blending functions of the plant.

DETAILED DESCRIPTION OF THE PREFERRED EMBODIMENTS

Figure 1:
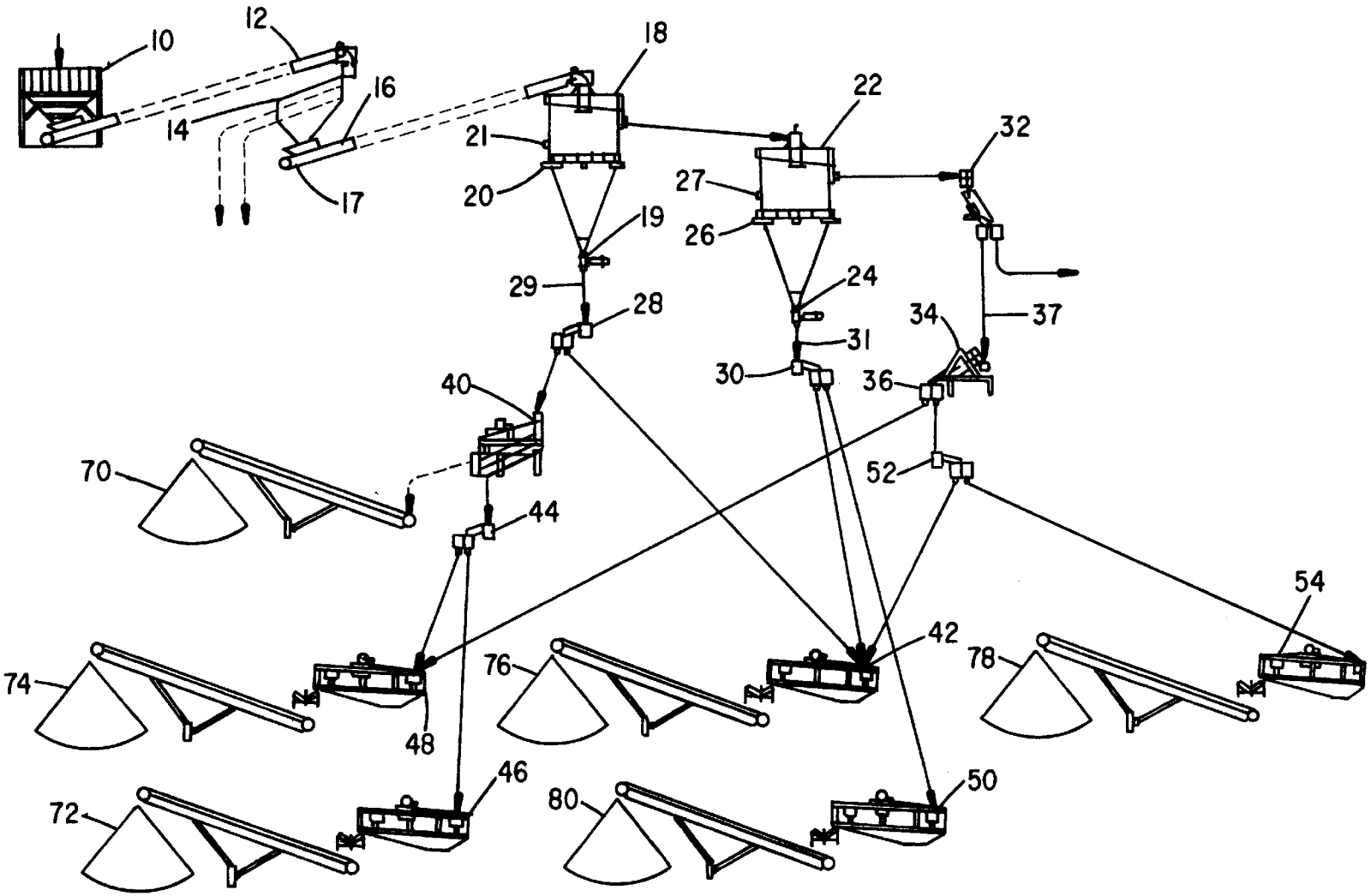
FIG. 1 is a diagram of a typical blending plant constructed in accordance with the present invention.
Figure 3A:
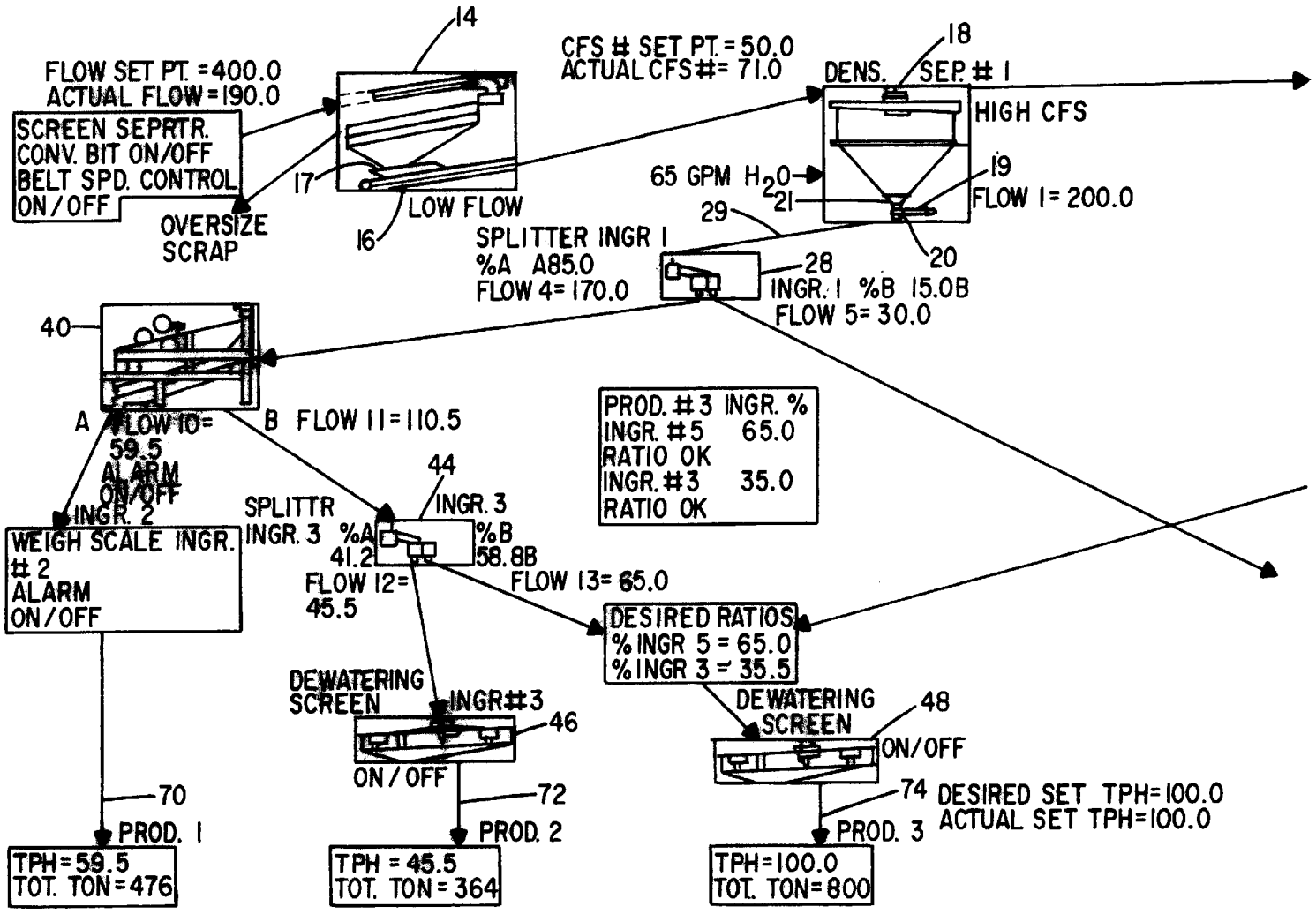
FIG. 3 is a schematic diagram showing example parameters which can be set for the various devices of the plant.
Figure 3B:
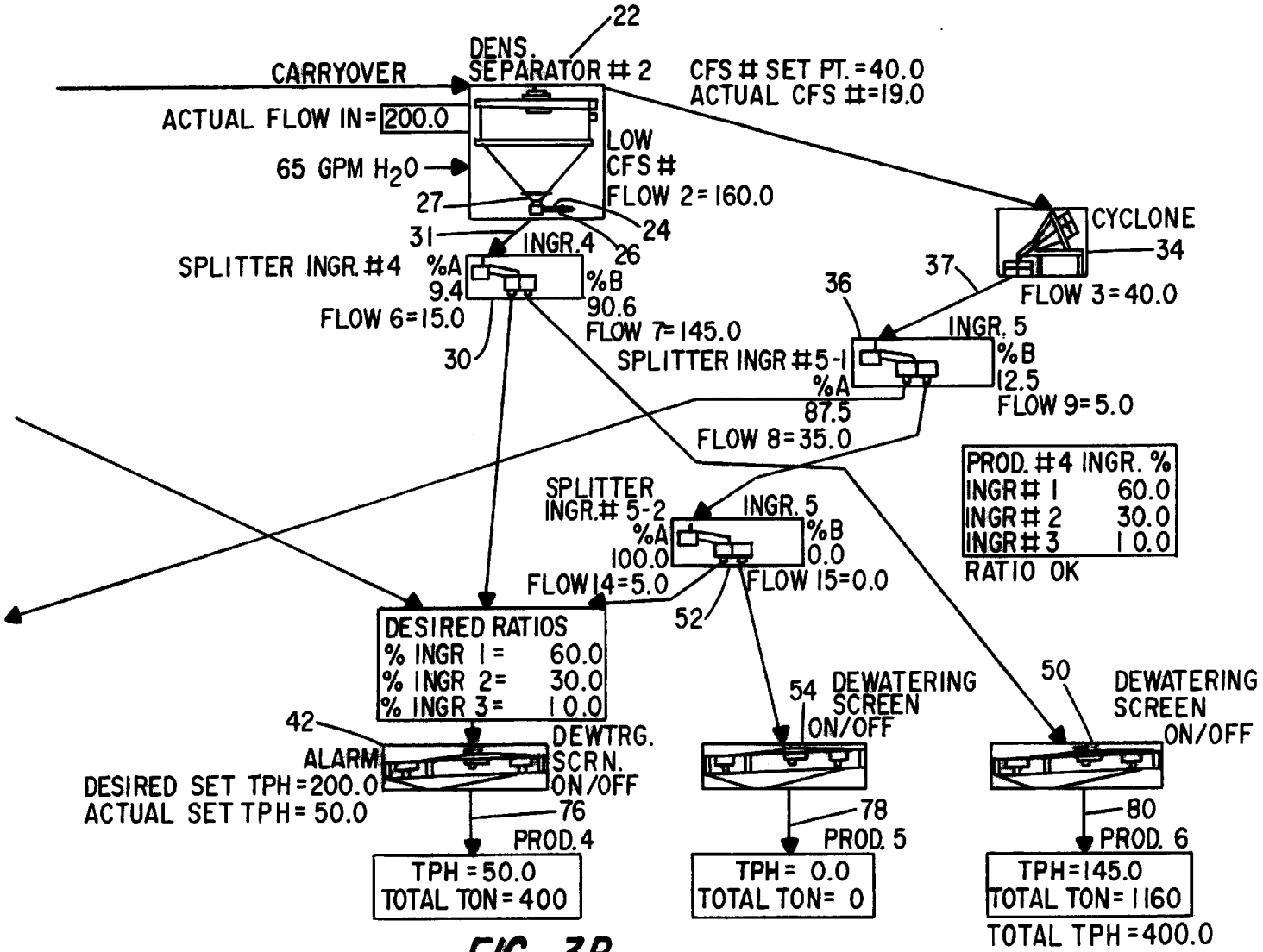
Figure 4:
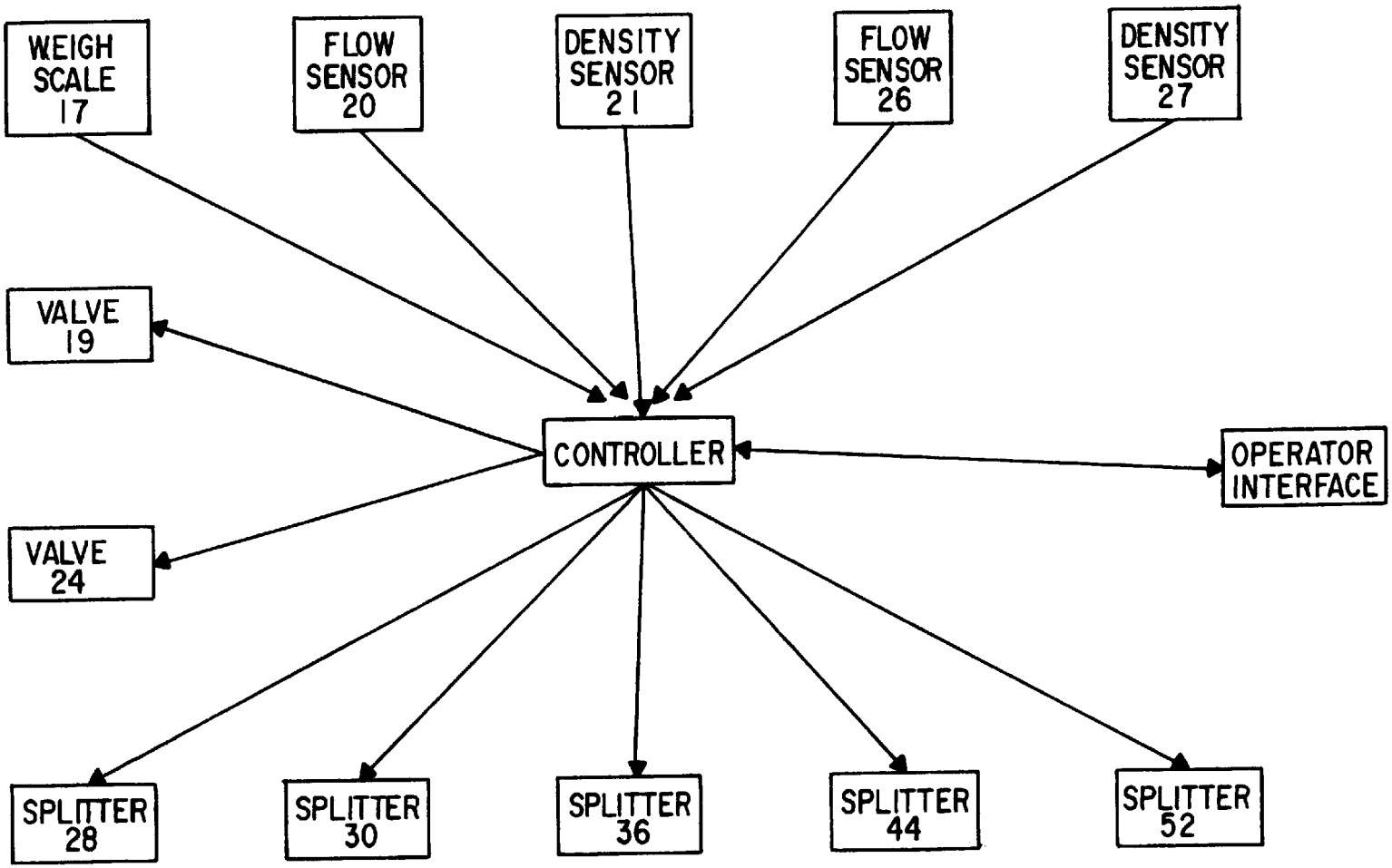
FIG. 4 is a schematic diagram showing the controller, the various sensors providing inputs and the various devices controlled by the controller.

In the embodiment shown in FIG. 1, raw material is fed into a feed hopper and meter 10 and from there, delivered in a metered fashion to a conveyor belt 12. Conveyor belt 12 then carries the material to a screen separator 14 which again divides the material into waste and usable material. The usable material drops through the screen 14 onto a second conveyor belt 16 which carries the material to a first density separator 18. Associated with the conveyor belt 16 is an electronic weigh scale 17 which measures the quantity of material being delivered to the density separator 18 by the conveyor 16. The weigh scale 17 sends signals to an electronic controller (not shown in FIG. 1). These signals are representative of the quantity of material being delivered to the density separator over a specified period of time (tons per hour).

The density separator 18 includes a discharge control valve 19 which can be, for example, actuated pneumatically in response to signals received from the electronic controller. By altering the position of the discharge control valve 19, the underflow fraction from the density separator 18 is adjusted. The operation of the density separator 18 is also monitored by a pair of sensors 20 and 21. Sensor 20 sends signals to the controller indicative of the amount of material being delivered as the underflow fraction of the density separator 18. Sensor 21 sends signals to the controller indicative of the pulp density of the material within the density separator. The controller, thus, knows the amount of material being delivered to the density separator 18 based upon the signals received from the scale 17 and the quantity of material being delivered as the underflow fraction by virtue of the signals received from the sensor 20. The controller can use this data to determine the quantity of material delivered as the overflow fraction of the density separator 18. The controller also knows the pulp density of the material within the density separator 18 based upon signals received from sensor 21. The controller can also use this information to modulate the position of the valve 19. Specifically, the controller adjusts the valve 19 to generate an overflow of a fine fraction and an underflow of a coarse fraction each having specific particle size distributions irrespective of the size distribution of the raw material fed into density separator 18. The sensor 20 is used to determine what percentage of the material fed into the density separator 18 is being delivered as part of the coarse underflow fraction versus the fine overflow fraction.

A key aspect of the invention is the manner in which the controller can determine the particle size distribution of the raw material. The controller is able to make this determination because of the signals it receives from sensors 20 and 21. By knowing the rate of discharge of the underflow (coarse) fraction exiting density separator 18 as well as the pulp density of material within the density separator 18, the controller can accurately calculate the particle size distribution of the raw material. More specifically, the controller can calculate the ratio of material of a size above or below a set point and extrapolate sufficiently precise information related to the size distribution of the raw material.

The system shown in FIG. 1 also includes a second density separator 22. Second density separator 22 is equipped with a valve 24 and sensors 26 and 27. The valve 24 is controlled by the electronic controller. The sensor 26 sends signals to the controller representative of the flow through the valve 24. The sensor 27 sends signals representative of the pulp density of the material in density separator 22. The density separator 22 receives the fine overflow fraction generated by the density separator 18 and separates this fine overflow fraction into a second fine overflow fraction and a second coarse underflow fraction. Again, the controller can determine the amount of material being delivered as the overflow fraction of the density separator 22 based upon signals received from the sensor 26 indicative of the amount of material in the underflow fraction and the calculation of the overflow fraction generated by density separator 18 discussed above.

The coarse underflow fraction of each density separator 18 and 22 is fed into a splitter. Specifically, splitter 28 receives a first flow stream 29 containing the coarse underflow fraction from the first density separator 18. Splitter 30 receives a second flow stream 31 containing the coarse underflow fraction from the density separator 22. In a similar fashion, a splitter 36 receives a third flow stream 37 via a static or vibrating DSM (dutch state mines) screen 32 and gravity cyclone 34. The DSM screen functions to remove coarse, lightweight contaminants which accompany the fine overflow fraction of density separator 22. Each of the splitters 28, 30 and 36, like the control valves 19 and 24, are controlled by the electronic controller. By virtue of the signals, the controller receives signals from the weigh scale 17 and the two sensors 20 and 26 associated with the two density separators, the controller is able to calculate the volume of material which is being delivered to each of the splitters 28, 30 and 36 and can use this information to control the splitters to create final products.

To further increase the flexability of the system, additional screens and splitters can be provided. The embodiment shown in FIG. 1, for example, includes a cascade screen 40, a splitter 44 and a splitter 52. The system also includes a plurality of dewatering screens 46, 48, 42, 54 and 50 respectively. As shown in FIG. 1, each dewatering screen has a separate conveyor associated therewith which is used to stockpile the final products. All of these devices can be controlled by the controller.

Starting first with the splitter 28, FIG. 1 shows that the splitter 28 is used to divide the first flow stream 29 and under electronic control deliver selected portions of it to the cascade screen 40 and to the dewatering screen 42. The portion of the first flow stream 29 delivered by splitter 28 to the cascade screen 40 is further separated by the screen 40 so that a portion is delivered to the splitter 44 and another portion becomes a first product 70. The material received by the splitter 44 is divided by the splitter under electronic control so that a portion is delivered to the dewatering screen 46 and becomes a second product 72 and the remaining portion is delivered to the dewatering screen 48.

FIG. 1 also shows how splitter 30 delivers the material contained in the second flow stream 31. Splitter 30 under electronic control, divides the second flow stream and delivers a first portion of it to dewatering screen 50 and a second portion to dewatering screen 42. The portion delivered to screen 50 becomes product 80.

The splitter 36, again under electronic control, is used to divide the third flow stream 37. A portion of this flow stream is delivered to dewatering screen 48. Another portion is delivered to splitter 52. The splitter 52 divides the material it receives between dewatering screen 42 and dewatering screen 54. The portion delivered to dewatering screen 54 becomes product 78.

Those skilled in the art will recognize from FIG. 1 that products 70, 72, 78 and 80 each contain a separate, single ingredient and products 74 and 76 comprise a mixture of ingredients. Product 74 is ultimately a mixture of material from the first flow stream 29 and the third flow stream 37. Likewise, product 76 is ultimately a mixture of material from the first flow stream 29, the second flow stream 31 and the third flow stream 37. The percentage of each ingredient in these mixture products is, of course, regulated by the controller.

In summary, the present invention allows a single raw material to be first divided into constituent parts which are utilized in such a way so as to create at least six separate products. Some of these products consist of a single constituent part of the raw material. Others of the product consist of blends of known adjustable ratios of said constituent parts. While not specifically shown in the drawings, it is also possible to take any of the final products and re-introduce them into the system as a raw material to further refine the material and achieve even more consistent final products.

In order to fully appreciate the level of control provided with the current system, some discussion of the controller is required. Basically the controller could be in the form of either a personal computer or specially designed microprocessor-based controller so long as the controller is equipped with various input and output devices. As indicated above, the inputs received by the controller include signals representative of weight received from the weigh scale 17, signals representative of flow through the valves 19 and 24 from the sensors 20, 21, 26 and 27 associated with the density separators. Other signals may also be received related to motor status, limit switches or the like from other sensors associated with the various components of the system such as the splitters and screens.

In addition to the various sensor inputs received by the controller, the operator will have the ability to enter various system parameters which will be used by the control algorithm, in combination with the sensor inputs, to control the operation of the system. Such operator inputs include a correction factor for mass conservation and waste lightweights and values for characterization of the valves 19 and 24. These values create a relationship between valve position and mass flow. Additionally, the operator can establish certain set points used by the system such as the pulp density for the two density separators as well as the flow rate of raw material into the system in tons per hour and the ratio values for ingredients in a given product where such product is a blended product, such as products 74 and 76. The operator can also input the desired flow rate for products so that the amount of each product produced can be adjusted and optimized. The operator can also set certain alarm limits for the controller so that a warning is signaled in the event there is too great a deviation from desired set points.

Thus, the operator can input the raw feed flow rate, the set points for the two density separators, and the ratio of the output in the form of various ingredients or products desired.

Those skilled in the art will recognize from the foregoing disclosure, that the present invention provides many advantages when it comes to separating and mixing particulate material to create predefined products. Those skilled in the art will also recognize that the system can be modified without deviating from the scope of the invention by adding additional density separators, splitters, cascade screens, cyclones or the like. By expanding the number of components and continuing to operate these components under program control, an even greater number of products can be delivered from a single plant. The user can modify the nature of any of the six products delivered by the system shown in the drawings by simply altering the operator inputs provided to the controller.

What is claimed:

1. An apparatus for separating a first mixture of substantially granular materials into its constituent parts and then remixing the constituent parts to achieve a second mixture having a desired composition, said apparatus comprising:

a. a first density separator which divides the first mixture into first and second flow streams, said first flow steam consisting of a first material having a first controlled density or size and said second flow stream consisting of a second material having a second controlled density or size less than said first controlled density or size;

b. a control valve for regulating the exit of said first flow stream from said density separator and for controlling the division of the first mixture into first and second flow streams by the first density separator;

c. a first sensor which provides an electrical signal indicative of the rate at which the material within said first flow stream is exiting said density separator;

d. a second sensor which provides a signal indicative of the pulp density of the material within said first density separator;

e. a first splitter associated with said first flow stream for controlling delivery of said first material;

f. an electronic programmable controller responsive to operator inputs and responsive in real time to the signals provided by said first sensor and second sensor which automatically controls said control valve and said first splitter to produce an ingredient having the desired composition and determines the particle size distribution of the first mixture.

2. The apparatus of claim 1 further including a screen for separating said first mixture from oversized material before the first mixture is deposited into the density separator.

3. The apparatus of claim 1 including a second sensor that provides a signal indicative of the rate at which the material within the first mixture is deposited into the density separator.

4. The apparatus of claim 1 including a second density separator positioned to receive the material of said second flow stream and divide the second flow stream into third and fourth flow streams, said third flow stream consisting of a third material having a third density or size and said fourth flow stream consisting of a fourth material having a density or size less than the density of said third flow stream.

5. The apparatus of claim 4 including a third sensor which provides signals indicative of the rate at which material within the third flow stream is exiting the second density separator and a second control valve for regulating the exit of said third flow stream from said second density separator.

6. The apparatus of claim 5 including a pulp density sensor which generates signals indicative of the pulp density of the material in said second density separator.

7. The apparatus of claim 6 including a second splitter associated with the third flow stream for controlling delivery of said third material and a third splitter associated with the fourth flow stream for controlling the delivery of said fourth material.

8. The apparatus of claim 7 wherein said programmable controller is also responsive in real time to signals provided by said third sensor and said pulp density sensor and also automatically controls said second control valve and said second and third splitters to produce a plurality of mixtures, each having the desired composition.

9. The apparatus of claim 8 wherein the first splitter deposits a portion of the first material onto a cascade screen which divides said portion of said first material into a fifth flow stream consisting of a fifth material and a sixth flow stream consisting of a sixth material, said fifth material constituting a first product, said sixth material being deposited into a fourth splitter controlled by said programmable controller to provide a second product.

10. The apparatus of claim 9 wherein the programmable controller controls said third splitter and said fourth splitter to provide a third product which is a predefined mixture of said fourth material and said sixth material.

11. The apparatus of claim 10 further including a fifth splitter which receives at least a portion of said fourth material from said third splitter and is controlled by said programmable controller to create a fourth product.

12. The apparatus of claim 11 wherein said programmable controller controls said first, second and fifth splitters to create a fifth product which is a predefined mixture of said first, third and fourth material.

13. The apparatus of claim 12 wherein said second splitter is controlled to provide a sixth product from said third material.

14. The apparatus of claim 1 including a plurality of dewatering screens.

15. The apparatus of claim 14 including at least one conveyor for stockpiling at least one product.

16. The apparatus of claim 1 including a DSM screen to remove lightweight contaminants from the second flow stream.

17. The apparatus of claim 4 including a DSM screen to remove lightweight contaminants from the fourth flow stream.

18. The apparatus of claim 16 or 17 further including a gravity cyclone.

19. An apparatus of claim 1 further including a scale for measuring the weight of the material entering the density separator such that the controller can calculate the volume of the material being delivered to the splitter.

* * * * *

UNITED STATES PATENT AND TRADEMARK OFFICE

CERTIFICATE OF CORRECTION

PATENT NO. : 6,085,912
DATED : July 11, 2000
INVENTOR(S) : Earl L. Hacking, Jr., et al It is certified that error appears in the above-indentified patent and that said Letters Patent is hereby corrected as shown below:

The title of the invention should read as follows:
-- APPARATUS FOR SORTING AND RECOMBINING MINERALS --.

Claim 1, column 5, line 59 delete the word "steam" and insert -- stream --.

Signed and Sealed this

Tenth Day of April, 2001

*Attest:*

NICHOLAS P. GODICI

*Attesting Officer*

*Acting Director of the United States Patent and Trademark Office*